US007641454B2

(12) United States Patent
Ueda et al.

(10) Patent No.: US 7,641,454 B2
(45) Date of Patent: Jan. 5, 2010

(54) TWO-STAGE ROTARY COMPRESSOR

(75) Inventors: Kenshi Ueda, Kanagawa (JP); Naoya Morozumi, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 0 days.

(21) Appl. No.: 12/235,018

(22) Filed: Sep. 22, 2008

(65) Prior Publication Data

US 2009/0081053 A1 Mar. 26, 2009

(30) Foreign Application Priority Data

Sep. 25, 2007 (JP) ..... 2007-247454

(51) Int. Cl.
*F03C 2/00* (2006.01)
*F03C 4/00* (2006.01)
*F04C 11/00* (2006.01)
*F04C 2/00* (2006.01)

(52) U.S. Cl. ..... 418/11; 418/60; 418/249; 418/270; 418/DIG. 1

(58) Field of Classification Search ..... 418/11, 418/28, 31, 60, 97, 249, 270, DIG. 1
See application file for complete search history.

(56) References Cited

U.S. PATENT DOCUMENTS 6,974,314 B2 * 12/2005 Matsumoto et al. ..... 418/11

FOREIGN PATENT DOCUMENTS

JP 57129286 A * 8/1982
JP 2006-152931 6/2006

* cited by examiner

*Primary Examiner*—Theresa Trieu
(74) *Attorney, Agent, or Firm*—McDermott Will & Emery LLP

(57) ABSTRACT

A two-stage rotary compressor includes a sealed cylindrical compressor housing that includes first, second and third communication holes separately arranged sequentially in an axial direction on an outer peripheral wall, an accumulator held on an outer side of the housing, a low-pressure connecting pipe that connects a bottom communication hole of the accumulator and the second communication hole, and an intermediate connecting pipe that connects the first and third communication holes. The second and third communication holes are arranged at nearly the same circumferential direction position of the housing. The accumulator is held at nearly the same circumferential direction position as the second communication hole. The first communication hole is arranged at a circumferential direction position different from the second and third communication holes to ensure that the low-pressure connecting pipe and the intermediate connecting pipe two dimensionally bent in a circular arc shape do not interfere with each other.

4 Claims, 8 Drawing Sheets

TWO-STAGE ROTARY COMPRESSOR

BACKGROUND OF THE INVENTION

1. Field of the Invention

The present invention relates to a two-stage rotary compressor (hereinafter, simply "rotary compressor").

2. Description of the Related Art

An existing rotary compressor includes, inside a cylindrical compressor housing that is a sealed container, a low-stage compressing section, a high-stage compressing section, and a motor that drives the low-stage compressing section and the high-stage compressing section. Further, the rotary compressor includes an accumulator on an outer side of the compressor housing.

A first communication hole, a second communication hole, and a third communication hole are separately arranged on a straight line along a central axial direction in an outer peripheral wall of the cylindrical compressor housing. One end of a low-stage suction pipe, which sucks a low-pressure gas refrigerant Ps that is inside the accumulator, is connected to a suction hole of the low-stage compressing section via the second communication hole.

Further, one end of a low-stage discharge pipe, which discharges a low-stage discharge gas refrigerant Pm outside the compressor housing, is connected to a discharge hole of the low-stage compressing section via the first communication hole. One end of a high-stage suction pipe, which sucks the low-stage discharge gas refrigerant Pm, is connected to a suction hole of the high-stage compressing section via the third communication hole. The other end of the low-stage suction pipe and the accumulator are connected by a low-pressure connecting pipe. The other end of the low-stage discharge pipe and the high-stage suction pipe are connected by an intermediate connecting pipe.

A flow of a gas refrigerant due to the pipe connections mentioned earlier is explained next. The low-pressure gas refrigerant Ps is sucked from the accumulator and passes through the low-pressure connecting pipe and the low-stage suction pipe. Next, the low pressure gas refrigerant Ps is sucked inside the low-stage compressing section due to the suction hole of the low-stage compressing section and compressed to an intermediate pressure, thus becoming the low-stage discharge gas refrigerant Pm.

The low-stage discharge gas refrigerant Pm, which is of the intermediate pressure that is discharged in a low-stage discharge space, passes through the low-stage discharge pipe, the intermediate connecting pipe, and the high-stage suction pipe. Next, the low-stage discharge gas refrigerant Pm is sucked inside the high-stage compressing section from the suction hole of the high-stage compressing section, and compressed to a high pressure, thus becoming a high-stage discharge gas refrigerant Pd. The high-stage discharge gas refrigerant Pd is discharged in an internal space of the compressor housing, passes through a gap of the motor, and is discharged to a refrigerating cycle from a discharge pipe. A conventional technology has been disclosed, for example, in Japanese Patent Application Laid-open No. 2006-152931.

However, in the conventional technology mentioned earlier, because the first communication hole, the second communication hole, and the third communication hole are separately arranged in a straight line along the central axial direction in the outer peripheral wall of the cylindrical compressor housing, for avoiding interference of the circular arc shaped intermediate connecting pipe that connects the low-stage discharge pipe and the high-stage suction pipe, the low-pressure connecting pipe that connects the low-stage suction pipe and the accumulator is three dimensionally bent at a right angle at two points, thus resulting in a complex shape. Due to this, a pipeline resistance increases and a pressure loss of a refrigerant increases, thus worsening compression efficiency of the rotary compressor.

Further, because a distance between the respective communication holes of the compressor housing is short, a pressure resistance of the compressor housing decreases. Moreover, a welding (brazing) operation of the low-pressure connecting pipe and the low-stage suction pipe becomes difficult. Similarly, a welding (brazing) operation of the intermediate connecting pipe with the low-stage discharge pipe and the high-stage discharge pipe becomes difficult.

SUMMARY OF THE INVENTION

It is an object of the present invention to at least partially solve the problems in the conventional technology.

According to an aspect of the present invention, a two-stage rotary compressor includes a sealed cylindrical compressor housing that includes a first communication hole, a second communication hole, and a third communication hole that are separately arranged sequentially in an axial direction on an outer peripheral wall; a low-stage compressing section that is arranged inside the compressor housing, in which one end of a low-stage suction pipe is connected to a low-stage suction hole via the second communication hole and one end of a low-stage discharge pipe is connected to a low-stage discharge hole via the first communication hole; and a high-stage compressing section that is arranged in the vicinity of the low-stage compressing section inside the compressor housing, in which one end of a high-stage suction pipe is connected to a high-stage suction hole via the third communication hole and a high-stage muffler discharge hole communicates with inside of the compressor housing. The two-stage rotary compressor also includes a motor that drives the low-stage compressing section and the high-stage compressing section; a sealed cylindrical accumulator that is held on an outer side of the compressor housing; a low-pressure connecting pipe that connects a bottom communication hole of the accumulator and another end of the low-stage suction pipe; and an intermediate connecting pipe that connects another end of the low-stage discharge pipe and another end of the high-stage suction pipe. The second communication hole and the third communication hole are arranged in nearly the same circumferential direction position of the cylindrical compressor housing. The accumulator is held at nearly the same circumferential direction position as the second communication hole. The first communication hole is arranged at a circumferential direction position different from the second communication hole and the third communication hole to ensure that the low-pressure connecting pipe and the intermediate connecting pipe that are two dimensionally bent in a circular arc shape do not interfere with each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a rotary compressor according to the present invention are explained below with reference to the accompanying drawings. The present invention is not limited to the embodiments explained below.

Figure 1A:
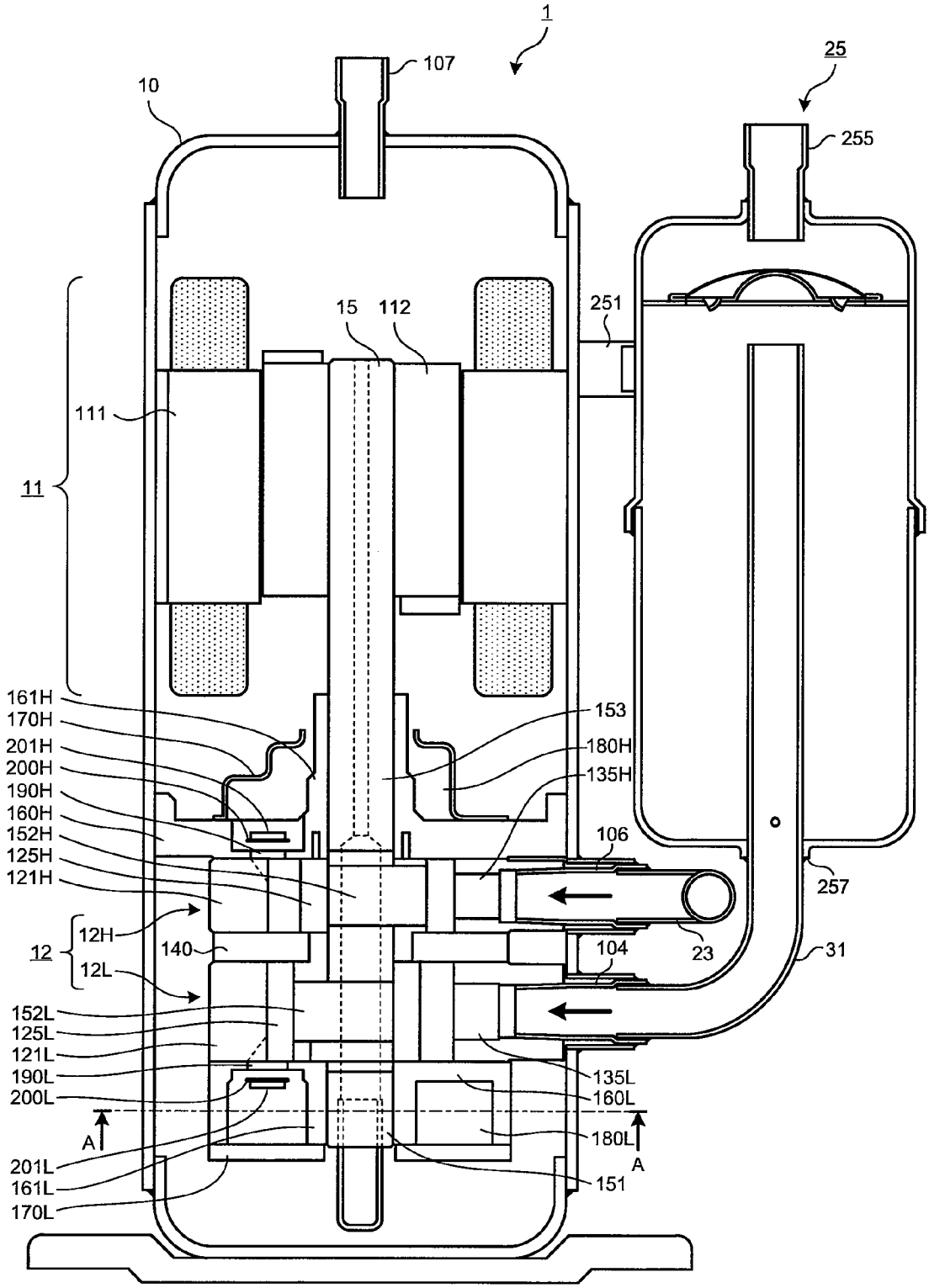
FIG. 1A is a longitudinal cross-sectional view of a rotary compressor according to a first embodiment of the present invention.
Figure 1B:
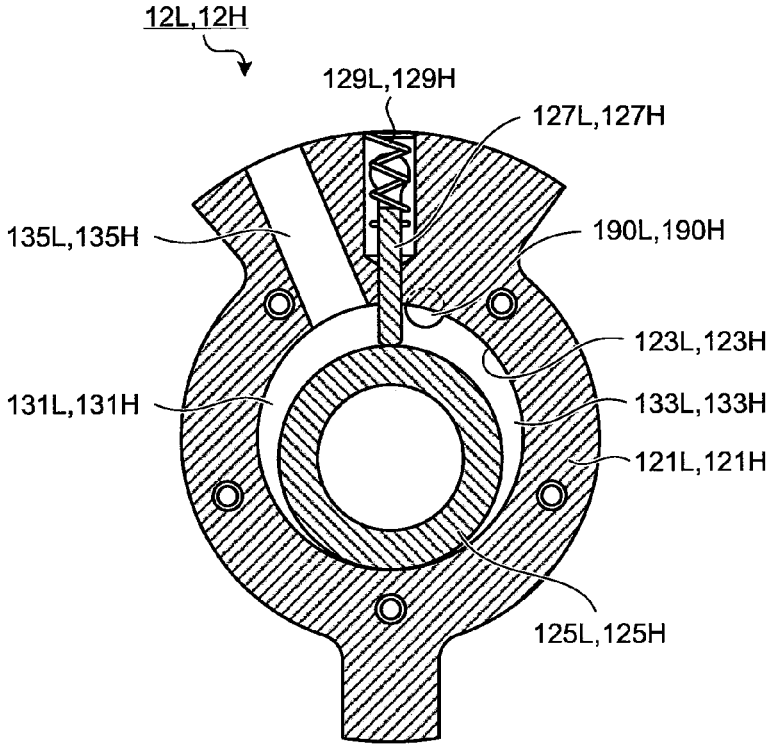
FIG. 1B is a cross-sectional view of a low-stage compressing section and a high-stage compressing section of the rotary compressor of FIG. 1A.
Figure 1C:
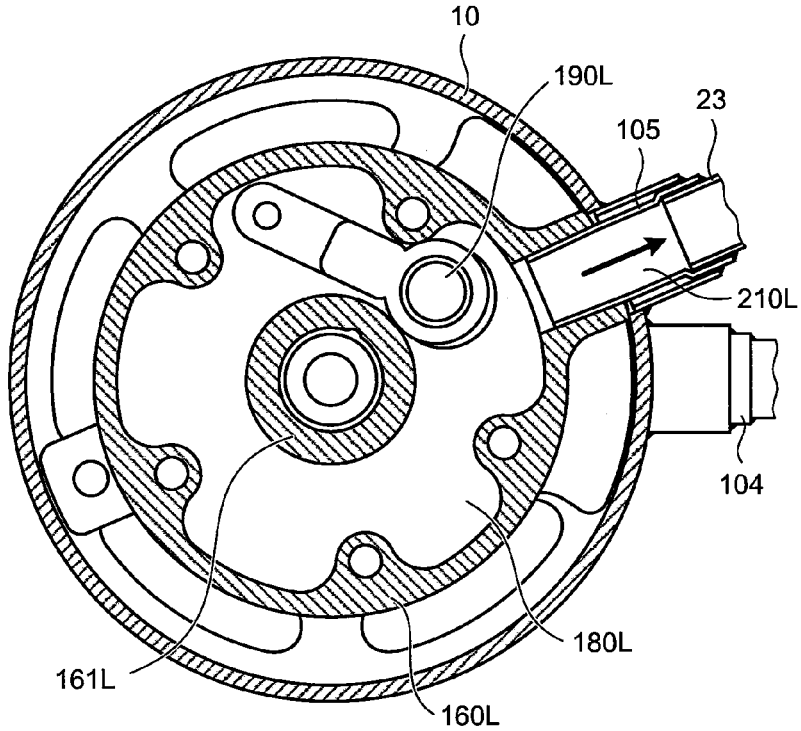
FIG. 1C is a cross-sectional view of the rotary compressor taken along line A-A of FIG. 1A.
Figure 1D:
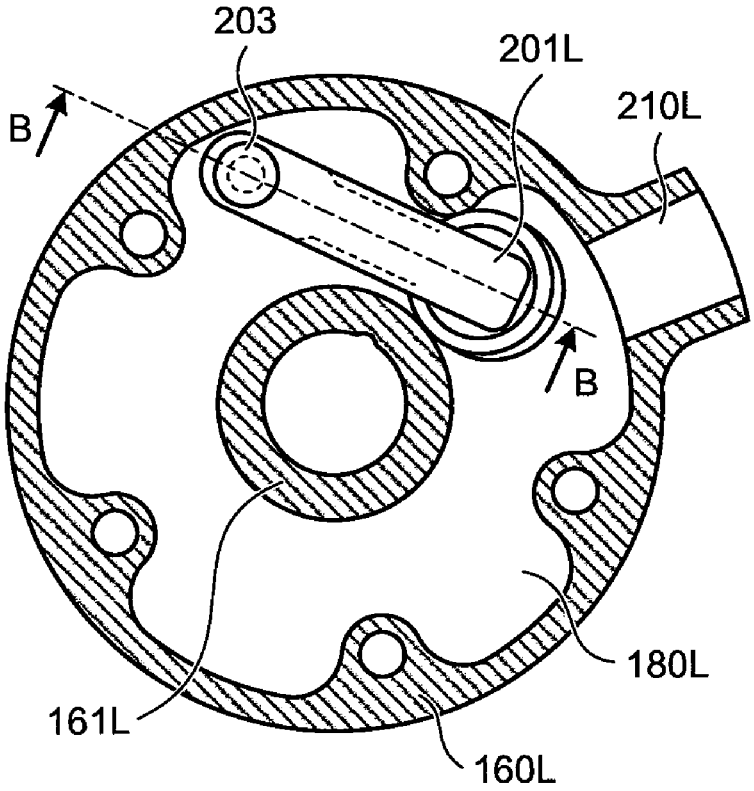
FIG. 1D is a cross-sectional view of a low-stage end plate.
Figure 1E:
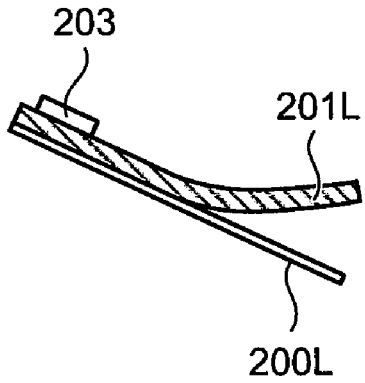
FIG. 1E is a cross-sectional view of the rotary compressor taken along line B-B of FIG. 1D.
Figure 1F:
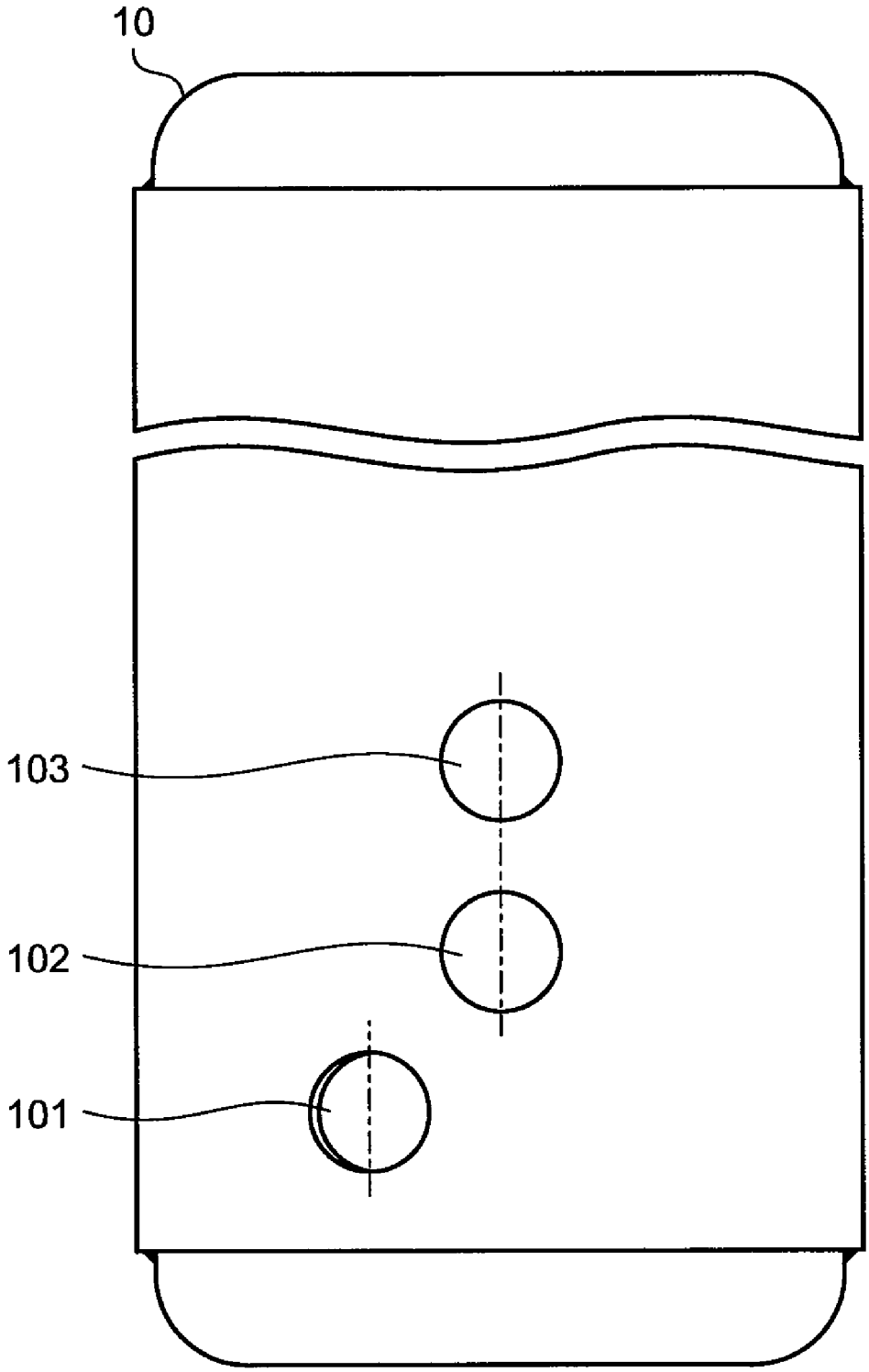
FIG. 1F is a front view of a compressor housing.
Figure 1G:
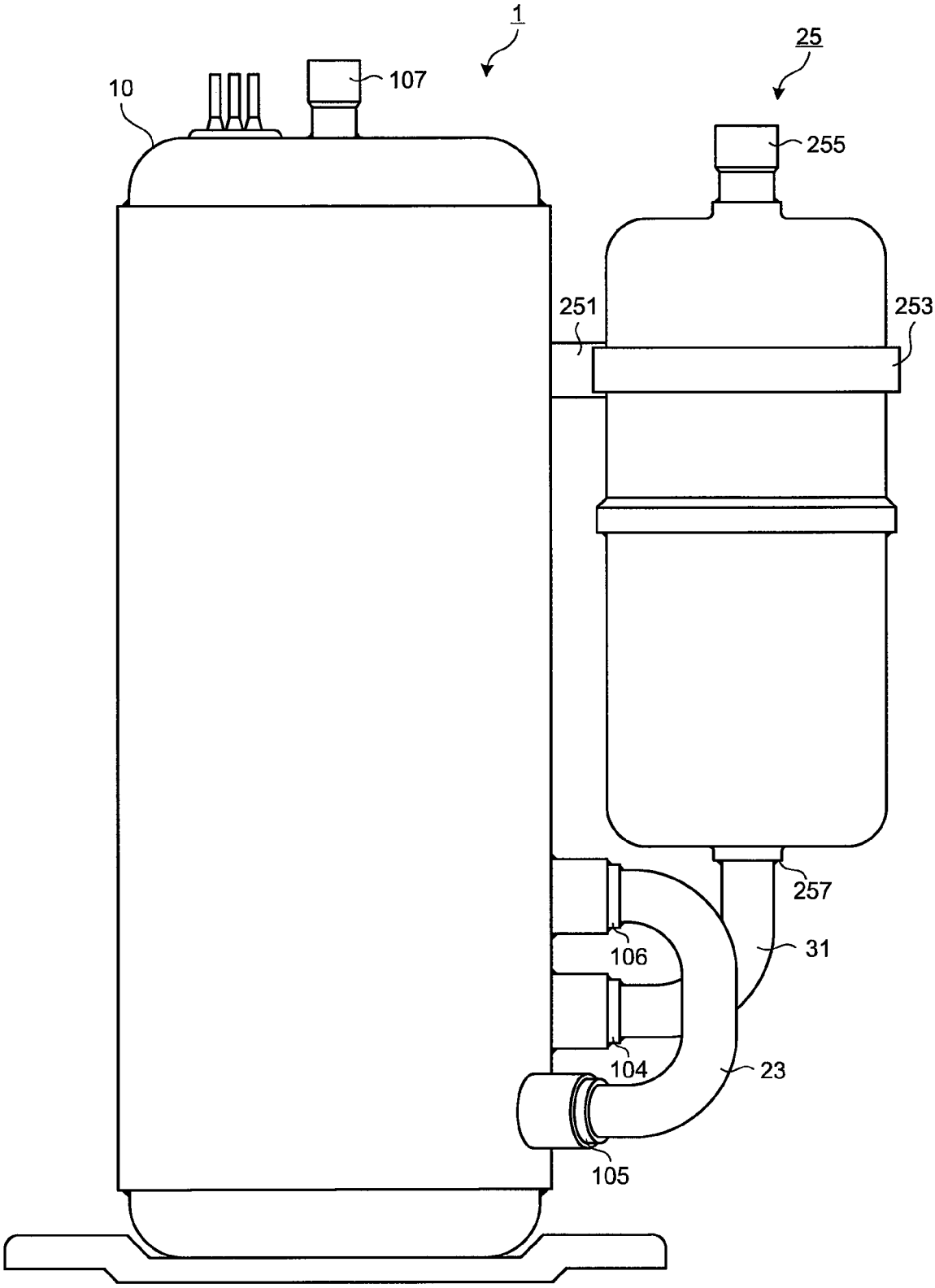
FIG. 1G is a side view of the rotary compressor according to the first embodiment.

FIG. 1A is a longitudinal cross-sectional view of a rotary compressor according to a first embodiment of the present invention. FIG. 1B is a cross-sectional view of a low-stage compressing section and a high-stage compressing section of the rotary compressor shown in FIG. 1A. FIG. 1C is a cross-sectional view of the rotary compressor taken along line A-A of FIG. 1. FIG. 1D is a cross-sectional view of a low-stage end plate. FIG. 1E is a cross-sectional view of the rotary compressor taken along line B-B of FIG. 1D. FIG. 1F is a front view of a compressor housing. FIG. 1G is a side view of the rotary compressor according to the first embodiment.

As shown in FIG. 1A, a rotary compressor 1 according to the first embodiment includes inside a sealed cylindrical compressor housing 10, a compressing section 12 and a motor 11 that drives the compressing section 12.

A stator 111 of the motor 11 is fixed by thermal insert on an inner peripheral surface of the compressor housing 10. A rotor 112 of the motor 11 is arranged in a central portion of the stator 111. The rotor 112 is fixed by thermal insert to a shaft 15 that mechanically connects the motor 11 and the compressing section 12.

The compressing section 12 includes a low-stage compressing section 12L and a high-stage compressing section 12H. The high-stage compressing section 12H, which is serially connected to the low-stage compressing section 12L, is arranged on the upper side of the low-stage compressing section 12L. As shown in FIG. 1B, the low-stage compressing section 12L includes a low-stage cylinder 121L and the high-stage compressing section 12H includes a high-stage cylinder 121H.

A low-stage cylinder bore (hole) 123L and a high-stage cylinder bore 123H are formed, concentrically with the motor 11, on the low-stage cylinder 121L and the high-stage cylinder 121H respectively. A low-stage piston 125L and a high-stage piston 125H, which have an external diameter that is less than a bore diameter, are arranged inside the low-stage cylinder bore 123L and the high-stage cylinder bore 123H respectively. A compression space for compressing a refrigerant is formed between the low-stage cylinder bore 123L and the low-stage piston 125L and between the high-stage cylinder bore 123H and the high-stage piston 125H respectively.

A groove is formed in a radial direction from the low-stage cylinder bore 123L and the high-stage cylinder bore 123H on the low-stage cylinder 121L and the high-stage cylinder 121H respectively along the entire height of the low-stage cylinder 121L and the high-stage cylinder 121H respectively. A low-stage vane 127L and a high-stage vane 127H, which are plate shaped, are fitted inside the respective grooves. A low-stage spring 129L and a high-stage spring 129H are mounted on the compressor housing 10 side of the low-stage vane 127L and the high-stage vane 127H respectively.

The top ends of the low-stage vane 127L and the high-stage vane 127H are pressed against an outer peripheral surface of the low-stage piston 125L and the high-stage piston 125H respectively due to a repulsive force of the respective low-stage spring 129L and the high-stage spring 129H. Thus, the low-stage vane 127L and the high-stage vane 127H partition the compression space into a low-stage suction chamber 131L, a high-stage suction chamber 131H, a low-stage compression chamber 133L, and a high-stage compression chamber 133H.

A low-stage suction hole 135L and a high-stage suction hole 135H, which communicate with the low-stage suction chamber 131L and the high-stage suction chamber 131H respectively, are arranged on the low-stage cylinder 121L and the high-stage cylinder 121H respectively for sucking the refrigerant.

An intermediate partition plate 140, which is arranged between the low-stage cylinder 121L and the high-stage cylinder 121H, partitions the compression space of the low-stage cylinder 121L and the compression space of the high-stage cylinder 121H. A low-stage end plate 160L, which is arranged on a lower side of the low-stage cylinder 121L, blocks a lower portion of the compression space of the low-stage cylinder 121L. Similarly, A high-stage end plate 160H, which is arranged on an upper side of the high-stage cylinder 121H, blocks an upper portion of the compression space of the high-stage cylinder 121H.

A lower shaft receiver 161L is arranged on the low-stage end plate 160L and a lower portion 151 of the shaft 15 is rotatably supported on the lower shaft receiver 161L. An upper shaft receiver 161H is arranged on the high-stage end plate 160H and an intermediate portion 153 of the shaft 15 is fitted to the upper shaft receiver 161H.

The shaft 15 includes a low-stage crank 152L and a high-stage crank 152H that are eccentrically arranged such that there is a phase lag of 180° between the low-stage crank 152L and the high-stage crank 152H. The low-stage crank 152L rotatably holds the low-stage piston 125L of the low-stage compressing section 12L and the high-stage crank 152H rotatably holds the high-stage piston 125H of the high-stage compressing section 12H.

Upon rotating the shaft 15, the low-stage piston 125L and the high-stage piston 125H swirlingly move while rolling on an inner peripheral wall of the low-stage cylinder bore 123L and the high-stage cylinder bore 123H respectively. Due to this, the low-stage vane 127L and the high-stage vane 127H also follow in a reciprocatory movement. Due to movements of the low-stage piston 125L, the high-stage piston 125H, the low-stage vane 127L, and the high-stage vane 127H, volumes of the low-stage suction chamber 131L, the high-stage suction chamber 131H, the low-stage compression chamber 133L, and the high-stage compression chamber 133H continuously change. Thus, the compressing section 12 continuously sucks, compresses, and discharges the refrigerant.

A low-stage muffler cover 170L is arranged on a lower side of the low-stage end plate 160L and a low-stage muffler chamber 180L is formed between the low-stage end plate 160L and the low-stage muffler cover 170L. A discharging unit of the low-stage compressing section 12L opens in the low-stage muffler chamber 180L. In other words, a low-stage muffler discharge hole 190L, which communicates between the compression space of the low-stage cylinder 121L and the low-stage muffler chamber 180L, is arranged on the low-stage end plate 160L. A low-stage discharge valve 200L, which prevents a reverse flow of the compressed refrigerant, is arranged on the low-stage muffler discharge hole 190L.

As shown in FIGS. 1C and 1D, the low-stage muffler chamber 180L is a circular communicating chamber and forms a portion of an intermediate communicating path that communicates between a discharge side of the low-stage compressing section 12L and a suction side of the high-stage compressing section 12H.

As shown in FIGS. 1D and 1E, a low-stage discharge valve press 201L, which limits a deflection valve opening amount of the low-stage discharge valve 200L, is fixed on the low-stage discharge valve 200L by the low-stage discharge valve 200L and a rivet 203. Further, a low-stage discharge hole 210L, which discharges the refrigerant from inside the low-stage muffler chamber 180L, is arranged on an outer peripheral wall of the low-stage end plate 160L.

In a structure that indicates a salient feature of the present invention, the low-stage discharge hole 210L is arranged in a radial direction at a position that causes a phase lag in a circumferential direction of the compressor housing 10 between the low-stage suction hole 135L and the high-stage suction hole 135H of the compressing section 12.

A high-stage muffler cover 170H is arranged on an upper side of the high-stage end plate 160H and a high-stage muffler chamber 180H is formed between the high-stage end plate 160H and the high-stage muffler cover 170H. A high-stage muffler discharge hole 190H, which communicates between the compression space of the high-stage cylinder 121H and the high-stage muffler chamber 180H, is arranged on the high-stage end plate 160H. A high-stage discharge valve 200H, which prevents a reverse flow of the compressed refrigerant, is arranged on the high-stage muffler discharge hole 190H. Further, a high-stage discharge valve press 201H, which limits a deflection valve opening amount of the high-stage discharge valve 200H, is fixed on the high-stage discharge valve 200H by the high-stage discharge valve 200H and a rivet.

The low-stage cylinder 121L, the low-stage end plate 160L, the low-stage muffler cover 170L, the high-stage cylinder 121H, the high-stage end plate 160H, the high-stage muffler cover 170H, and the intermediate partition plate 140 are integrally fastened by a not shown bolt. In the compressing section 12, which is integrally fastened by the bolt, an outer periphery of the high-stage end plate 160H is fixed to the compressor housing 10 by spot welding, thus fixing the compressing section 12 to the compressor housing 10.

As shown in FIG. 1F, a first communication hole 101, a second communication hole 102, and a third communication hole 103 are separately arranged sequentially from a lower portion in an axial direction on the outer peripheral wall of the cylindrical compressor housing 10. The second communication hole 102 and the third communication hole 103 are arranged at nearly the same circumferential direction position of the compressor housing 10 and the first communication hole 101 is arranged at a different circumferential direction position than the second communication hole 102 and the third communication hole 103.

As shown in FIG. 1G, an accumulator 25, which is an independent sealed cylindrical container, is held on a front surface (nearly the same circumferential direction position as the circumferential direction position of the second communication hole 102 and the third communication hole 103) of the outer side of the compressor housing 10 by an accumulator holder 251 and an accumulator band 253. A system-connecting pipe 255, which connects the accumulator 25 with a refrigerating cycle side, is connected to a center in an apical portion of the accumulator 25. A low-pressure connecting pipe 31 is connected to a bottom communication hole 257 that is arranged in the center of a bottom portion of the accumulator 25. One end of the low-pressure connecting pipe 31 extends till the upper direction inside the accumulator 25 and the other end of the low-pressure connecting pipe 31 is connected to other end of a low-stage suction pipe 104.

The low-pressure connecting pipe 31, which guides the low pressure refrigerant of the refrigerating cycle to the low-stage compressing section 12L via the accumulator 25, is connected to the low-stage suction hole 135L of the low-stage cylinder 121L via the second communication hole 102 and the low-stage suction pipe 104. A portion of the low-pressure connecting pipe 31 between the low-stage suction pipe 104 and the bottom communication hole 257 of the accumulator 25 is two dimensionally bent in a quarter circular arc shape.

One end of a low-stage discharge pipe 105 is connected to the low-stage discharge hole 210L of the low-stage muffler chamber 180L via the first communication hole 101. One end of a high-stage suction pipe 106 is connected to the high-stage suction hole 135H of the high-stage cylinder 121H via the third communication hole 103. The other end of the low-stage discharge pipe 105 and the other end of the high-stage suction pipe 106 are connected by an intermediate connecting pipe 23 that is two dimensionally bent in a semicircular arc shape. The first communication hole 101 is arranged in a different circumferential direction position than the second communication hole 102 and the third communication hole 103 to ensure that the low-pressure connecting pipe 31 and the intermediate connecting pipe 23 do not interfere with each other.

A discharging unit of the high-stage compressing section 12H communicates with the inside of the compressor housing 10 via the high-stage muffler chamber 180H. In other words, the high-stage muffler discharge hole 190H, which communicates with the compression space of the high-stage cylinder 121H and the high-stage muffler chamber 180H, is arranged on the high-stage end plate 160H. The high-stage discharge valve 200H, which prevents the reverse flow of the compressed refrigerant, is arranged on the high-stage muffler discharge hole 190H. A discharging unit of the high-stage muffler chamber 180H communicates with the inside of the compressor housing 10. A discharge pipe 107, which discharges then high pressure refrigerant to the refrigerating cycle side, is connected to the apical portion of the compressor housing 10.

Lubricating oil is included inside the compressor housing 10 approximately until a height of the high-stage cylinder 121H. The lubricating oil circulates in the compressing section 12 due to a not shown blade pump that is fixed in a lower portion of the shaft 15. The lubricating oil lubricates the sliding components and seals the places where the compression space of the compressed refrigerant is partitioned by minute gaps.

Thus, in the rotary compressor 1 according to the first embodiment, the second communication hole 102 and the third communication hole 103 of the compressor housing 10 are arranged in nearly the same circumferential direction position of the compressor housing 10 and the first communication hole 101 is arranged in a different circumferential direction position than the second communication hole 102 and the third communication hole 103 to ensure that the low-pressure connecting pipe 31 and the intermediate connecting pipe 23 do not interfere with each other.

Due to this, the low-pressure connecting pipe 31 can be two dimensionally bent in a circular shape by bending at only one point. Thus, processing of the low-pressure connecting pipe 31 becomes easier and the cost is reduced. Further, a pipeline resistance and a suction pressure loss of the low-pressure connecting pipe 31 can be reduced, thereby enabling to enhance compression efficiency of the rotary compressor 1.

Further, a distance between the first communication hole 101 and the second communication hole 102 of the compressor housing 10 can be increased. Due to this, a pressure resistance of the portion of the compressor housing 10 between the communication holes can be enhanced and a welding (brazing) operation of the low-pressure connecting pipe 31 and the intermediate connecting pipe 23 is simplified.

Figure 2A:
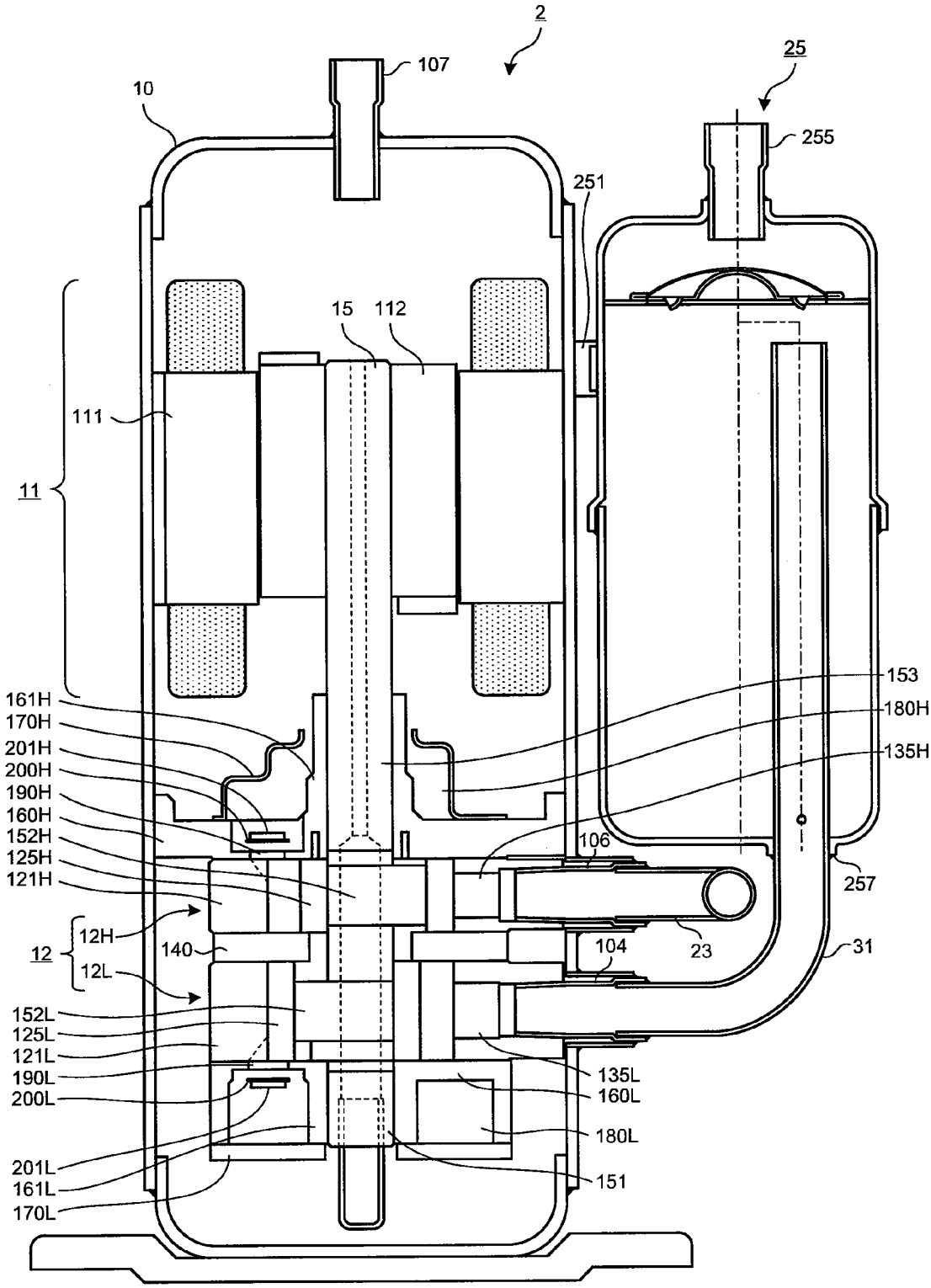
FIG. 2A is a longitudinal cross-sectional view of a rotary compressor according to a second embodiment of the present invention.
Figure 2B:
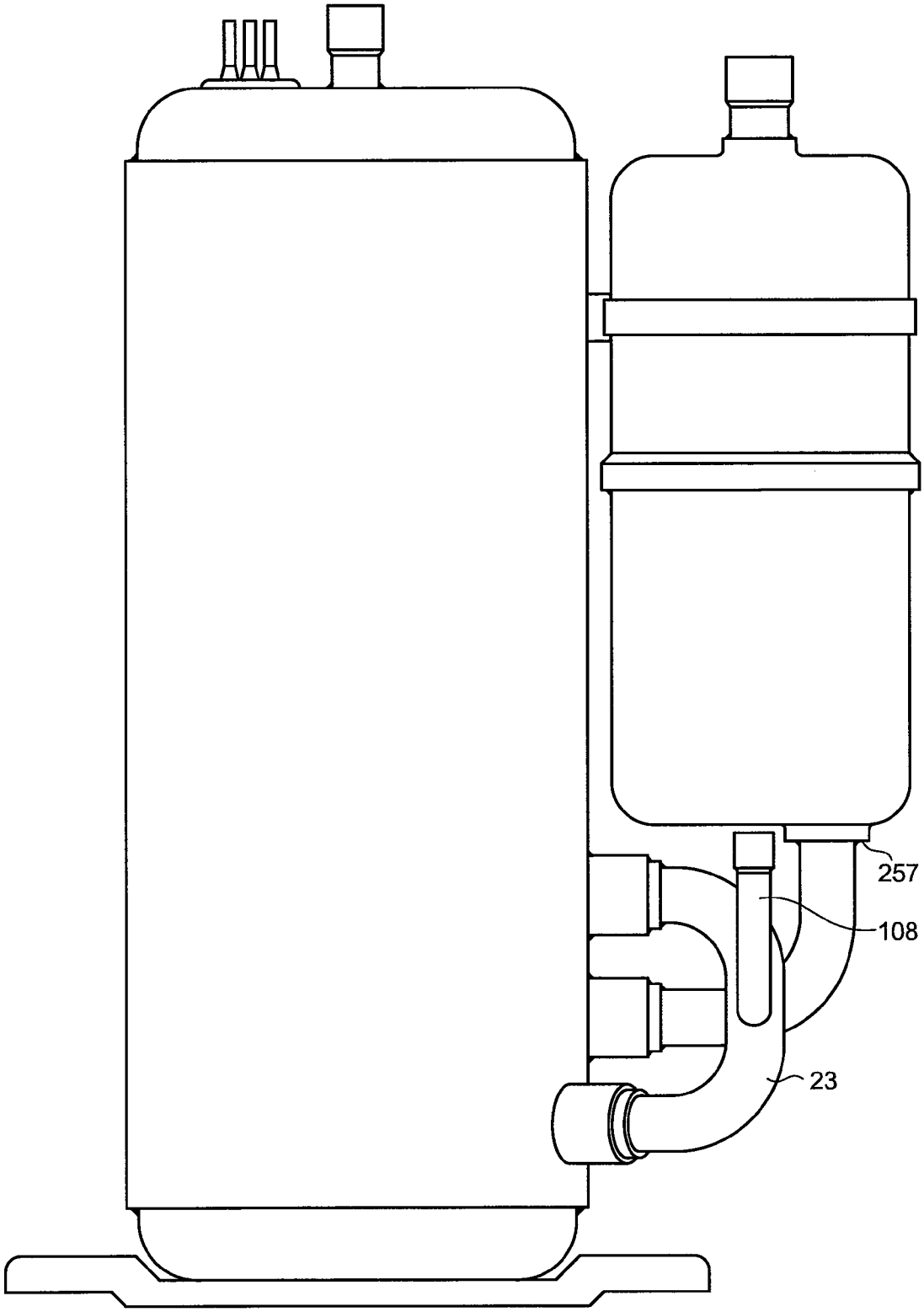
FIG. 2B is a side view of the rotary compressor according to the second embodiment.
Figure 2C:
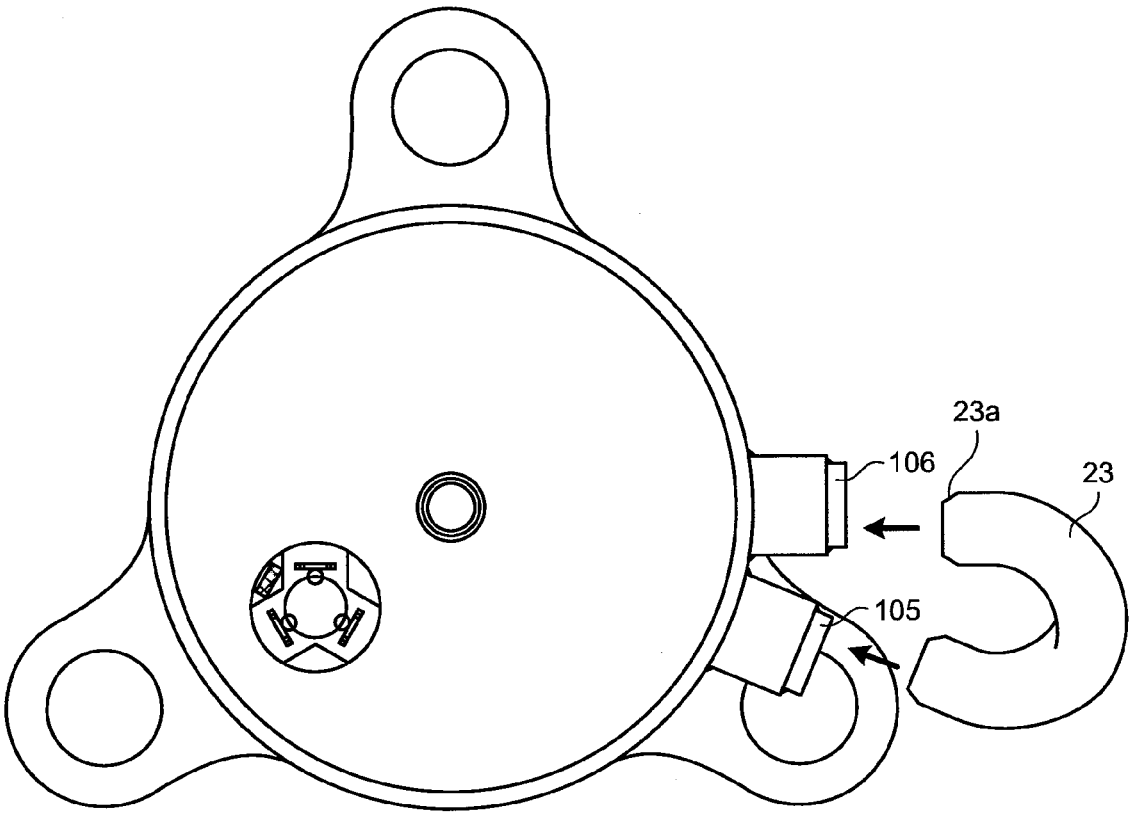
FIG. 2C is a plane view of the rotary compressor according to the second embodiment.

FIG. 2A is a longitudinal cross-sectional view of a rotary compressor according to a second embodiment of the present invention. FIG. 2B is a side view of the rotary compressor according to the second embodiment. FIG. 2C is a plane view of the rotary compressor according to the second embodiment. In a rotary compressor 2 according to the second embodiment, because only a pipe portion on the outer side of the compressor housing 10 differs from the rotary compressor 1 according to the first embodiment, only the differing portion is explained and an explanation of other components is omitted.

As shown in FIG. 1A, in the rotary compressor 1 according to the first embodiment, the low-pressure connecting pipe 31 which connects the low-stage compressing section 12L and the accumulator 25 is connected to the bottom communication hole 257 that is arranged in a central axial position of the accumulator 25. However, as shown in FIG. 2A, in the rotary compressor 2 according to the second embodiment, the bottom communication hole 257 is arranged at a position that is further separated from the compressor housing 10 than the central axial position of the accumulator 25.

Due to this, the accumulator 25 can be arranged in the vicinity of the compressor housing 10 and compactness of a rotary compressor assembly that includes the accumulator 25 can be enhanced. Further, a peripheral direction lag angle of the first communication hole 101 with respect to the second communication hole 102 and the third communication hole 103 can be restricted to a necessary minimum limit. Thus, a connection of the intermediate connecting pipe 23 with the low-stage discharge pipe 105 and the high-stage suction pipe 106 is simplified.

As shown in FIG. 2B, in the rotary compressor 2 according to the second embodiment, a gas injection cycle is used as the refrigerating cycle. An injection pipe 108 is connected to the intermediate connecting pipe 23 that connects a discharge side of the low-stage compressing section 12L and a suction side of the high-stage compressing section 12H, thus ensuring that an injection refrigerant can flow in.

As shown in FIG. 2C, a tapered portion 23*a*, which has an external diameter that reduces towards an end portion, can be arranged at both the ends (or only one end) of the intermediate connecting pipe 23. By arranging the tapering unit 23*a*, the connection of the intermediate connecting pipe 23 with the low-stage discharge pipe 105 and the high-stage suction pipe 106 is simplified.

Further, the rotational speed of the rotary compressor 2, including the motor 11, according to the second embodiment can also be changed. During a high-speed rotation, in other words, when a circulating refrigerant flow rate is high, because a pressure loss of the low-pressure connecting pipe 31 further increases, reducing the pipeline resistance of the low-pressure connecting pipe 31 is effective in enhancing efficiency.

In the compressing section 12 of the rotary compressors 1 and 2 according to the first and the second embodiments respectively, the high-stage compressing section 12H is arranged on the upper side of the low-stage compressing section 12L. However, the low-stage compressing section 12L can also be arranged on the upper side of the high-stage compressing section 12H.

In a rotary compressor according to an embodiment of the present invention, a pipeline resistance of a low-pressure connecting pipe is reduced, thus enhancing compression efficiency. Due to this, a pressure resistance of a compressor housing is enhanced and a welding (brazing) operation of the low-pressure connecting pipe and an intermediate connecting pipe is simplified.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A two-stage rotary compressor comprising:

a sealed cylindrical compressor housing that includes a first communication hole, a second communication hole, and a third communication hole that are separately arranged sequentially in an axial direction on an outer peripheral wall;

a low-stage compressing section that is arranged inside the compressor housing, in which one end of a low-stage suction pipe is connected to a low-stage suction hole via the second communication hole and one end of a low-stage discharge pipe is connected to a low-stage discharge hole, which is disposed below the low-stage suction hole, via the first communication hole;

a high-stage compressing section that is arranged above the low-stage compressing section inside the compressor housing, in which one end of a high-stage suction pipe is connected to a high-stage suction hole via the third communication hole and a high-stage muffler discharge hole communicates with inside of the compressor housing;

a motor that drives the low-stage compressing section and the high-stage compressing section;

a sealed cylindrical accumulator that is held on an outer side of the compressor housing;

a low-pressure connecting pipe that connects a bottom communication hole of the accumulator and another end of the low-stage suction pipe; and an intermediate connecting pipe that connects another end of the low-stage discharge pipe and another end of the high-stage suction pipe, wherein the second communication hole and the third communication hole are arranged in nearly the same circumferential direction position of the compressor housing, the accumulator is held at nearly the same circumferential direction position as the second communication hole, and the first communication hole is arranged at a circumferential direction position different from the second communication hole and the third communication hole to ensure that the low-pressure connecting pipe and the intermediate connecting pipe that are two dimensionally bent in a circular arc shape do not interfere with each other.

2. The two-stage rotary compressor according to claim 1, wherein the bottom communication hole of the accumulator is arranged at a position that is further separated from the compressor housing than a central axial position of the accumulator.

3. The two-stage rotary compressor according to claim 1, wherein one end or both the ends of the intermediate connecting pipe are tapered portions whose external diameter reduces towards the end.

4. The two-stage rotary compressor according to claim 1, wherein the low-stage suction pipe is fitted to a low-stage cylinder of the low-stage compressing section, and the high-stage suction pipe is fitted to a high-stage cylinder of the high-stage compressing section.

* * * * *